US007736015B2

(12) United States Patent
Coushaine et al.

(10) Patent No.: US 7,736,015 B2
(45) Date of Patent: Jun. 15, 2010

(54) LED LIGHT

(75) Inventors: Charles M. Coushaine, Rindge, NH (US); Laura Peach, New Boston, NH (US)

(73) Assignee: Osram Sylvania, Inc, Danvers, MA (US)

( * ) Notice: Subject to any disclaimer, the term of this patent is extended or adjusted under 35 U.S.C. 154(b) by 19 days.

(21) Appl. No.: 11/899,061

(22) Filed: Sep. 4, 2007

(65) Prior Publication Data

US 2009/0059576 A1 Mar. 5, 2009

(51) Int. Cl.
*F21L 4/04* (2006.01)

(52) U.S. Cl. ..... 362/205; 362/800; 362/202

(58) Field of Classification Search ..... 362/103, 362/102, 202, 800

See application file for complete search history.

(56) References Cited

U.S. PATENT DOCUMENTS 5,785,407 A * 7/1998 Ratcliffe et al. ..... 362/101
6,461,015 B1 * 10/2002 Welch ..... 362/103
7,207,687 B1 * 4/2007 Reilly ..... 362/95
7,494,236 B2 * 2/2009 Lim ..... 362/102

* cited by examiner

*Primary Examiner*—Anabel M Ton
(74) *Attorney, Agent, or Firm*—William H. McNeill

(57) ABSTRACT

A light (10) comprising: a cup-shaped, substantially rigid base (12) having a circumferential ridge (14) on the outer wall (16) of the base (12); a battery (18) having first and second poles (20, 22) within the base (12); a PCB (24) overlying the battery (18) within the base (12), the PCB (24) having a plurality of apertures (26) therein, at least one of the apertures (26) containing a LED (28) having first and second lead-ins (20*a*, 22*a*), a first of the lead-ins (20*a*) being electrically connected to the first pole (20) via a connector (30); switch means (32) associated with the PCB (24) electrically connecting the second lead-in (22*a*) to the second pole (22); and a cup-shaped, flexible, translucent cover (34) on the base, the wall (36) of the cover (34) engaging the outer wall (16) and the circumferential ridge (14).

5 Claims, 4 Drawing Sheets

LED LIGHT

TECHNICAL FIELD

This invention relates to lighting and more particularly to portable lights. Still more particularly, it relates to portable lights employing light emitting diodes (LED or LEDs) as the light source.

BACKGROUND ART

Light emitting diodes have very long lives and are very small. Accordingly, it would be an advantage to utilize these features in a portable light that was easily attachable to objects where incidental illumination was difficult to achieve. It would further be desirable if the light was inexpensive, convenient to use and able to provide at least two signaling functions.

DISCLOSURE OF INVENTION

These objects are accomplished, in one aspect of the invention, by the provision of a light comprising a cup-shaped, substantially rigid base having a circumferential ridge on an outer wall of the base; a battery having first and second poles within the base; a printed circuit board (PCB) overlying the battery within the base, the PCB having a plurality of apertures therein, at least one of the apertures containing a LED having first and second lead-ins, a first of the lead-ins being electrically connected to the first pole via a connector; switch means associated with the PCB electrically connecting the second lead-in to the second pole; and a cup-shaped, flexible, translucent cover on the base, the wall of the cover engaging the outer wall and the circumferential ridge.

In a preferred embodiment of the invention, plural attachment means are supplied with the light, for example, a double-sided tape, provided on the outside bottom of the base and a magnet provided within the base. The magnet allows the light to be mounted upon metallic objects, such, for example, as a refrigerator, while the double-sided tape allows the light to be mounted upon other, non-magnetic objects.

In another embodiment, the light can be provided with a switch that allows a steady illumination or a blinking illumination, the latter being more effective at drawing the attention of a person.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
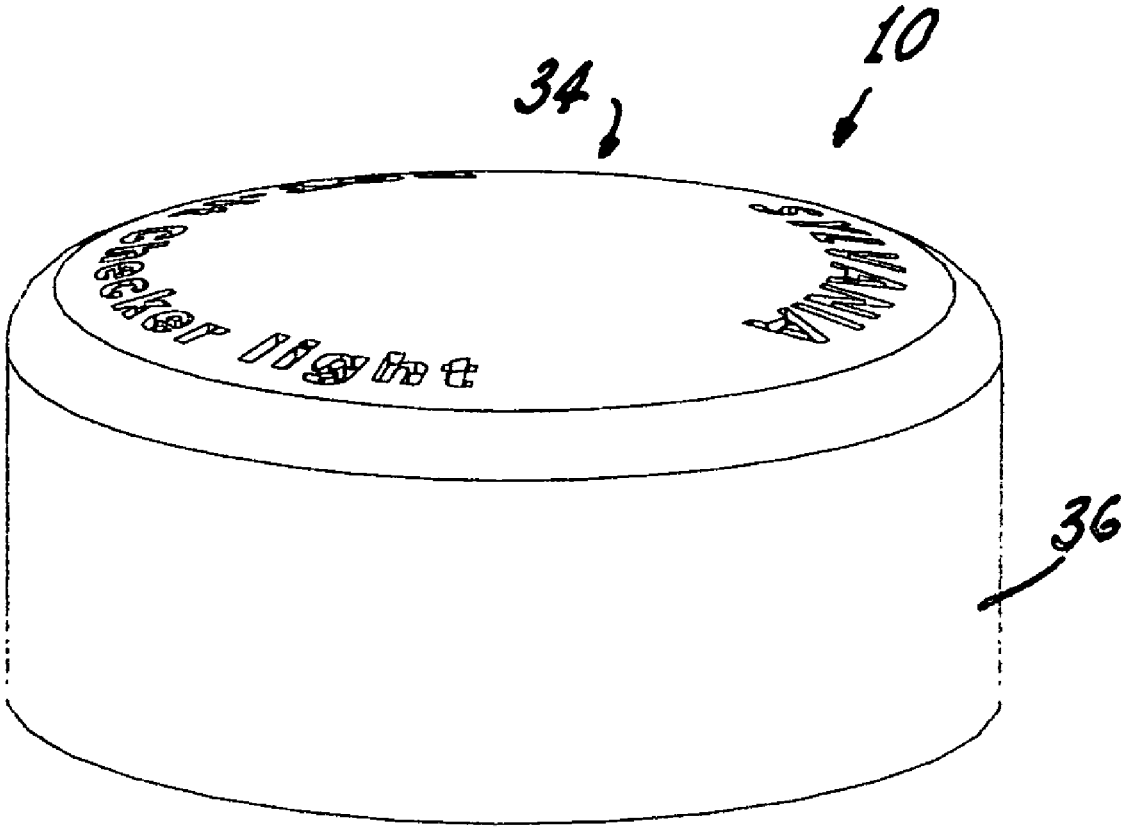
FIG. 1 is a top perspective view of an embodiment of the invention.
Figure 2:
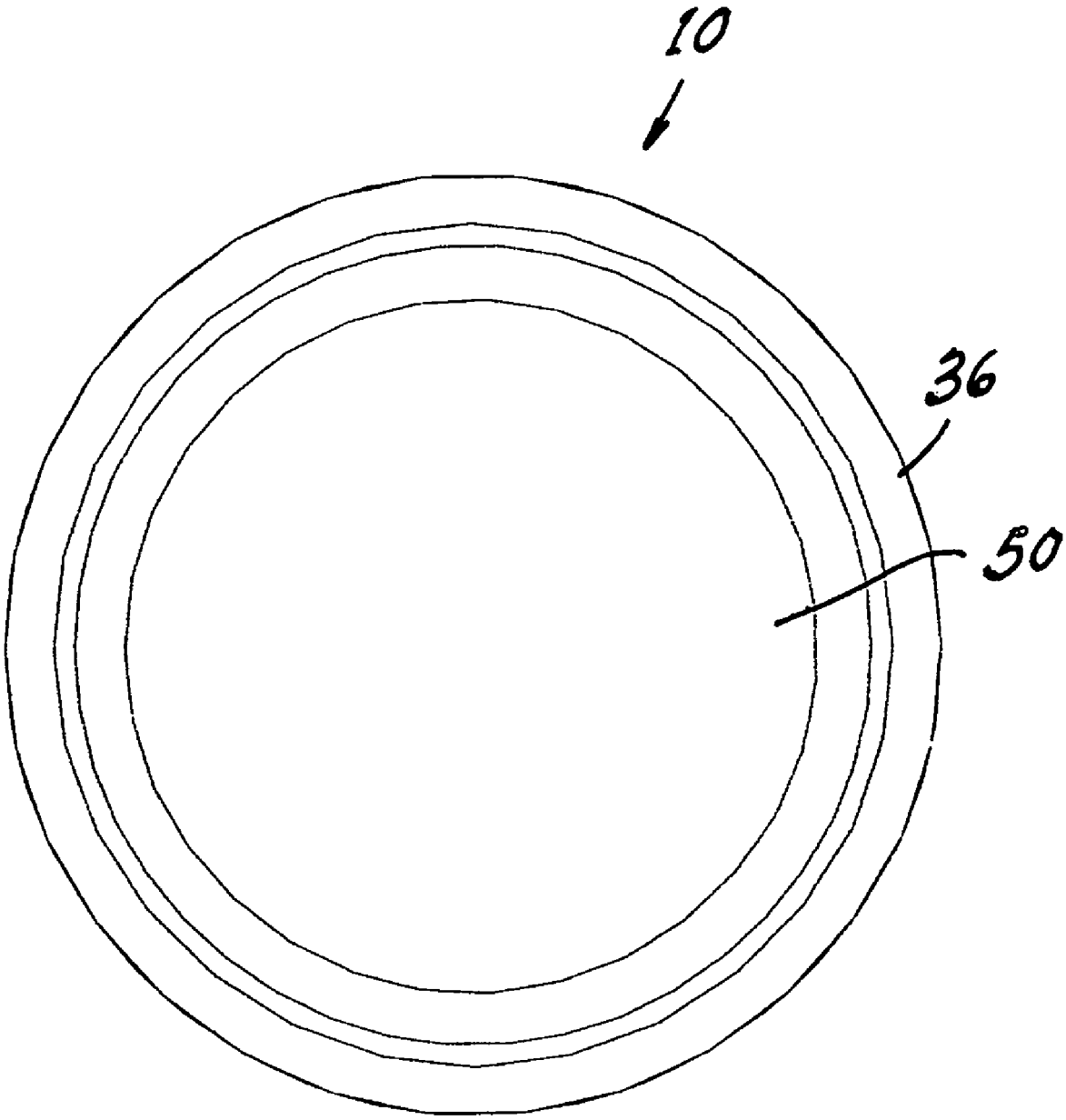
FIG. 2 is a bottom perspective view of an embodiment of the invention.
Figure 3:
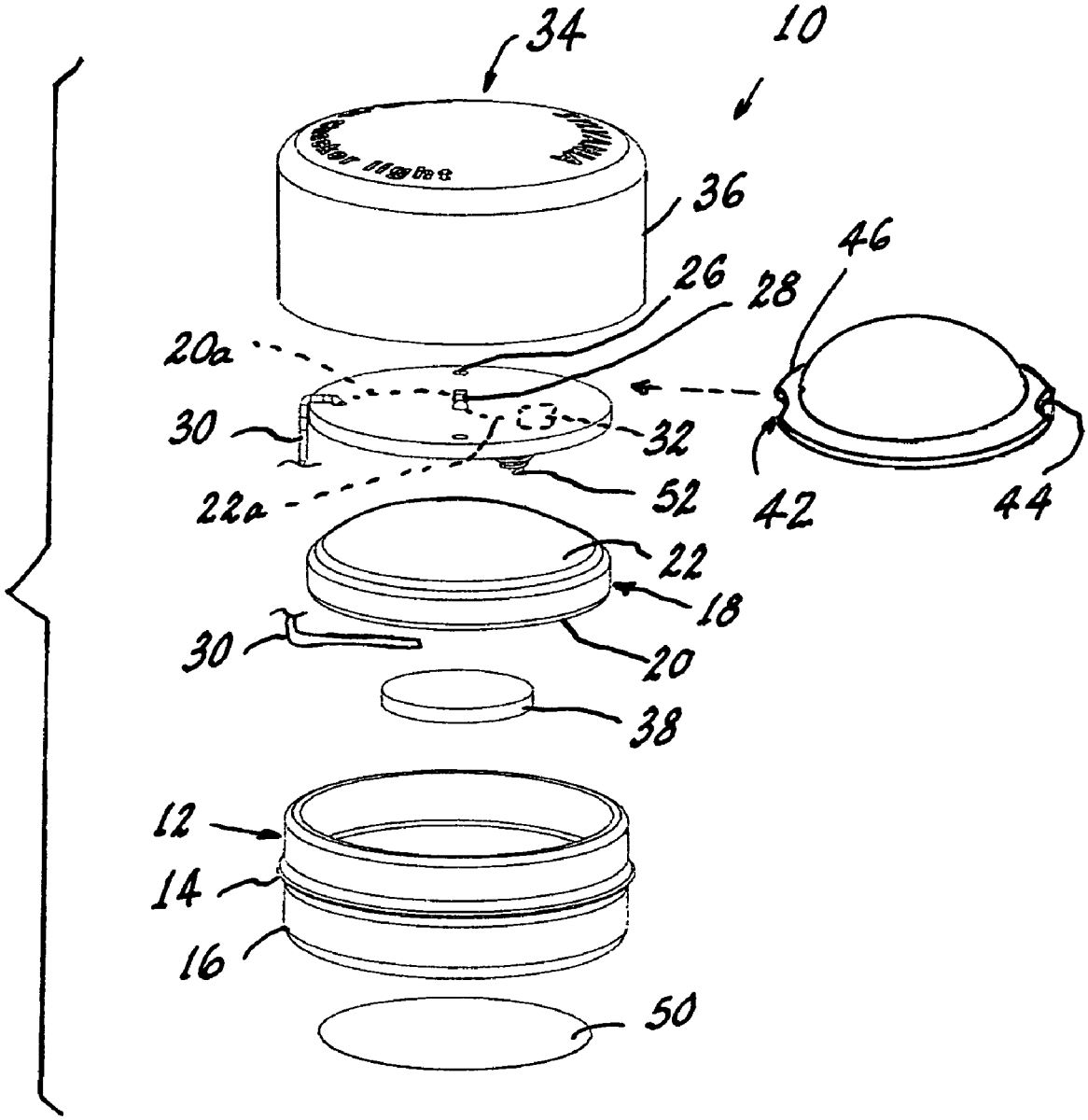
FIG. 3 is an exploded perspective view of a light according to an aspect of the invention.
Figure 4:
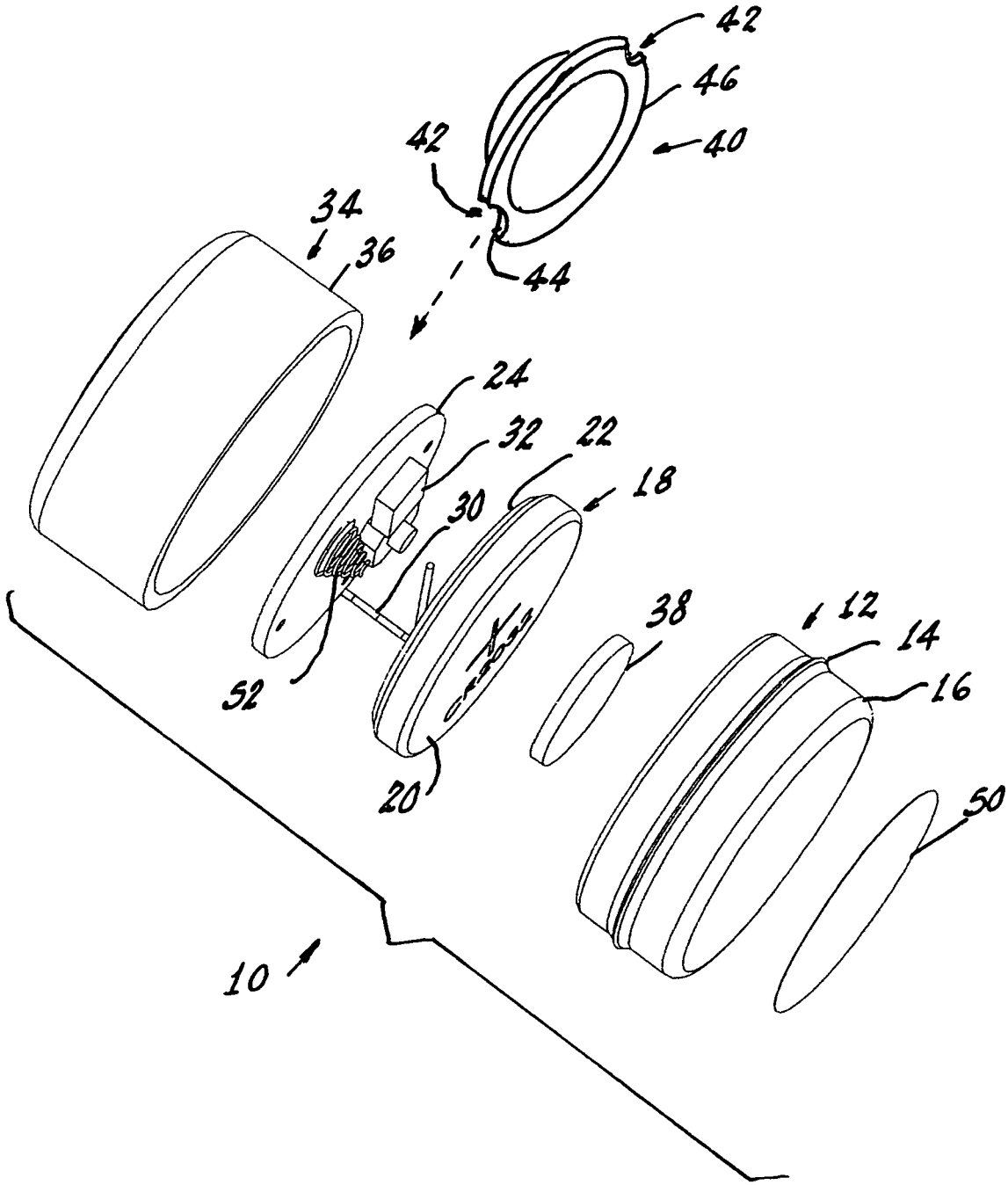
FIG. 4 is a similar exploded view from a different direction.

Referring now to the drawings with greater particularity, there is shown in FIG. 3 a light 10 comprising: a cup-shaped, substantially rigid base 12 having a circumferential ridge 14 on the outer wall 16 thereof. The base is constructed of any suitable material, such as an ABS plastic.

A battery 18 having first and second poles 20, 22 is positioned within the base 12. While any suitable battery can be employed, a preferred battery is a lithium type 2032.

A PCB 24 overlies the battery 18 within the base 12, the PCB 24 having a plurality of apertures 26 therein, at least one of the apertures 26 containing a LED 28 having first and second lead-ins 20*a*, 22*a*, a first of the lead-ins 20*a* being electrically connected to the first pole 20 via a connector 30. Switch means 32 is associated with the PCB 24 and electrically connects the second lead-in 22*a* to the second pole 22. A cup-shaped, flexible, translucent cover 34 is positioned on the base, with the wall 36 of the cover 34 engaging the outer wall 16 and the circumferential ridge 14. The cover 30 is preferably made from Silicone having a Durometer hardness of 30. This allows the cover 30 to form a watertight seal with the circumferential ridge 14 on the wall 16. A spring 52 affixed to the PCB allows the light to be operated in a push-on, push-off manner.

Preferably, the LED 28 emits light of a given color and the translucent cover 34 substantially matches the given color.

The base 12 includes a permanent magnet 38 fitted beneath the battery 18 that allows the light 10 to be removeably positioned on any convenient magnetic surface.

A double-sided tape 50 is provided on the base 12 allowing the light 10 to be positioned on virtually any object. A suitable tape is type 9495LE, available from Minnesota Mining and Manufacturing Co. (3M).

A transparent concavo-convex disc 40 overlies the PCB 24 and covers the LED 28; the disc including pressure relieving means 42, such as at least one cutout 44, which can be formed on an edge 46 of the disc 40. The disc 40, with its pressure relieving cutouts, permits the cover to flex after actuation, as without the disc it is possible for the cover, upon actuation, to create a small vacuum that prevents the cover from returning to it original orientation.

Thus, there is provided a small, simple and inexpensive portable light that can be used in multiple ways. Preferably, the switch 32 allows for the light to be energized in at least two ways, as a steady light and as a blinking light. The light is watertight and yet allows easy battery replacement, in the event such action should be necessary.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A light comprising:

a cup-shaped, substantially rigid base having a circumferential ridge on the outer wall of said base;

a battery having first and second poles within said base;

a PCB overlying said battery within said base, said PCB having a plurality of apertures therein, at least one of said apertures containing a LED having first and second lead-ins, a first of said lead-ins being electrically connected to said first pole via a connector;

switch means associated with said PCB electrically connecting said second lead-in to said second pole; and a cup-shaped, flexible, translucent cover on said base, the wall of said cover engaging said outer wall and said circumferential ridge.

2. The light of claim 1 wherein said LED emits light of a given color and said translucent cover substantially matches said given color.

3. The light of claim 1 wherein said base includes a permanent magnet.

4. The light of claim 1 wherein a transparent concavo-convex disc overlies said PCB and covers said LED; said disc including pressure-relieving means.

5. The light of claim 4 wherein said pressure-relieving means comprises at least one cutout formed on an edge of said disc.

* * * * *